US005451830A

United States Patent [19]

Huang

[11] Patent Number: 5,451,830

[45] Date of Patent: Sep. 19, 1995

[54] SINGLE TIP REDUNDANCY METHOD WITH RESISTIVE BASE AND RESULTANT FLAT PANEL DISPLAY

[75] Inventor: Jammy C. Huang, Taipei, Taiwan

[73] Assignee: Industrial Technology Research Institute, Hsinchu, Taiwan

[21] Appl. No.: 184,919

[22] Filed: Jan. 24, 1994

[51] Int. Cl.[6] ..... H01J 1/30

[52] U.S. Cl. ..... 313/309; 313/336; 445/50

[58] Field of Search ..... 445/24, 50; 313/309, 313/336

[56] References Cited

U.S. PATENT DOCUMENTS

| | | | |
|---|---|---|---|
| 3,500,102 | 3/1970 | Crost et al. | 313/109 |
| 3,789,471 | 2/1974 | Spindt et al. | 29/25.17 |
| 3,921,022 | 11/1975 | Levine | 313/309 |
| 4,551,649 | 11/1985 | Olson | 313/309 |
| 4,763,187 | 8/1988 | Biberian | 358/56 |
| 4,835,438 | 5/1989 | Baptist et al. | 313/309 |
| 4,857,161 | 8/1989 | Borel et al. | 204/192.26 |
| 4,857,799 | 8/1989 | Spindt et al. | 313/495 |
| 4,940,916 | 7/1990 | Borel et al. | 313/306 |
| 5,209,687 | 5/1993 | Konishi | 445/24 |
| 5,249,340 | 10/1993 | Kane et al. | 445/50 |

OTHER PUBLICATIONS

R. Meyer in "Recent Development of Microtips Display at Leti" in Technical Digest of IVMC91 Ngahama 1991 pp. 6–9.

*Primary Examiner*—Kenneth J. Ramsey
*Attorney, Agent, or Firm*—George O. Saile; Stephen B. Ackerman

[57] ABSTRACT

A high resolution matrix addressed flat panel display having single field emission microtip redundancy with resistive base is described. Parallel, spaced conductors acting as cathode columns for the display are over the substrate. A layer of insulation is formed over the cathode columns. Parallel, spaced conductors acting as gate lines for the display are formed over the layer of insulation at a right angle to the cathode columns. The intersections of the cathode columns and gate lines are pixels of the display. A plurality of openings at the pixels extend through the insulating layer and the gate lines. At each of the openings is a resistive base connected to the cathode conductor column. A small field emission microtip is formed on each resistive base, extending up from the resistive base and into the openings, the height of the microtip being many times smaller than the height of the resistive base.

35 Claims, 7 Drawing Sheets

SINGLE TIP REDUNDANCY METHOD WITH RESISTIVE BASE AND RESULTANT FLAT PANEL DISPLAY

BACKGROUND OF THE INVENTION

1. Field of the Invention

The invention relates to field emission flat panel displays, and more particularly to methods for making a high resolution matrix addressed flat panel display having single field emission microtip redundancy with resistive base and the resulting display.

2. Description of the Related Art

U.S. Pat. No. 4,763,187 to J. P. Biberian generally discusses field emission device structures including tips emitting electrons to light a fluorescent screen, using lines and columns for addressing. The structure includes a grid, at a third voltage potential (the first two potentials being those of the cathode and anode) which is used to control electron emission intensity. Biberian says that the grid solves the problem of needing low voltage levels (to allow for fast switching) but without requiring very small spacing, on the order of a few microns, between the tips and the anode structure. A few micron spacing would cause great difficulty in manufacturing. His structure using the grid also allows for the separate control of the address and intensity functions.

Another matrix addressed flat panel display is shown in U.S. Pat. No. 4,857,799 by C. A. Spindt et al. He refers to U.S. Pat. No. 3,500,102 by Crost et al which deals with a thin display using field emission, but which did not deal with gaseous breakdown, and which would still have a problem of distortion in the display picture, due to screen deflection from pressure difference between atmospheric pressure and vacuum inside display. Solutions to this problem proposed by Spindt et al included: 1) a "support structure" to prevent the distortion, 2) spacing between the cathodes and luminescent material which is less than or equal to the mean free path of electrons in the interelectrode space—this would help reduce gas breakdown, and 3) isolating the cathode conductive lines by using semiconductive material between the conductive lines, to reduce cross-talk.

The U.S. Pat. No. 4,857,161 to Borel et al shows a process for the production of an array of cathode lines and grid lines that are used to address each picture element. At each picture element there are many micro-emitters that are grown on the corresponding cathode line. The many micro-emitters provide redundancy, so that if one emitter fails, there is no degradation in the display.

The U.S. Pat. No. 4,940,916 to Borel et al addresses two problems with the Borel et al U.S. Pat. No. 4,857,161, that is cathode destruction and non-uniform emission or "bright spots" on the display. During startup of the display, current surges due to degasification occur, including arcing between the grids, points and anodes, leading to cathode destruction (the cathode is unable to carry current and opens). Initially a resistor was added between the power source and the cathode lines, but under certain conditions this led to the bright spots problem. His solution was to add a resistive layer covering the cathode layer and under the microtips. His purpose is to prevent cathode destruction and offer good thermal dissipation.

The resistive layer approach described by Borel et al still has the problem that it cannot sustain cathode-gate voltage, and subsequent explosions cause a dead short between the gate and cathode. A solution for this is proposed by A. Meyer in "RECENT DEVELOPMENT ON 'MICROTIPS' DISPLAY AT LETI" in TECHNICAL DIGEST of IVMC 91 NAGAHAMA 1991 PAGES 6 to 9. The solution is to form a meshed conductor of the cathode lines. This has the effect of moving the cathode farther from the emitters for a longer resistive path. The conductor mesh also provides additional redundancy.

However, the meshed conductor of Meyer has less value as the display resolution is increased and/or a smaller pixel size is desired. Therefore, the resolution is unsatisfactory for the pixel sizes needed today.

Spindt in U.S. Pat. No. 3,789,471 discusses generally the formation of field emission cathode structures, and in one embodiment the formation of a pedestal for forming an emitter tip thereon.

SUMMARY OF THE INVENTION

An object of this invention is to provide a high resolution matrix addressed flat panel display having single field emission microtip redundancy with resistive base which is satisfactory for pixel sizes needed by today's displays.

Another object of this invention is to provide a very manufacturable method of fabricating a high resolution matrix addressed flat panel display having single field emission microtip redundancy with resistive base which is satisfactory for pixel sizes needed by today's displays.

The flat panel display having single field emission microtip redundancy with resistive base includes a base of resistive material under each microemitter tip. This resistive base can be formed directly on the cathode conductor, or used in conjunction with a meshed conductor and a single tip per subpixel. The resistive base may be a single layer of resistive material, or consist of alternating metal and resistive layers.

The above objects are achieved by a high resolution matrix addressed flat panel display having single field emission microtip redundancy with resistive base. Parallel, spaced conductors acting as cathode columns for the display are over the substrate. A layer of insulation is formed over the cathode columns. Parallel, spaced conductors acting as gate lines for the display are formed over the layer of insulation at a right angle to the cathode columns. The intersections of the cathode columns and gate lines are pixels of the display. A plurality of openings at the pixels extend through the insulating layer and the gate lines. At each of the openings is a resistive base connected to the cathode conductor column. A small field emission microtip is formed on each resistive base, extending up from the resistive base and into the openings, the height of the microtip being many times smaller than the height of the resistive base.

A method of fabricating a high resolution matrix addressed flat panel display having cathode columns and gate lines and single field emission microtip redundancy with resistive base is accomplished as follows. Parallel, spaced conductors acting as the cathode columns for the display are formed on a dielectric base substrate. A layer of insulation is formed over the cathode columns. The intersections of the cathode columns and gate lines are pixels of the display. Spaced conductors acting as gate lines for the display are formed over the layer of insulation at a right angle to the cathode columns. A plurality of openings is formed at the pixels extending through the insulating layer and the gate lines. A resistive base is formed in each of the openings and is connected to the cathode conductor column. A small field emission microtip is formed over the resistive base, extending up from the resistive base and into the opening, the height of the microtip being many times smaller than the height of the resistive base.

DESCRIPTION OF THE PREFERRED EMBODIMENTS

Figure 1:
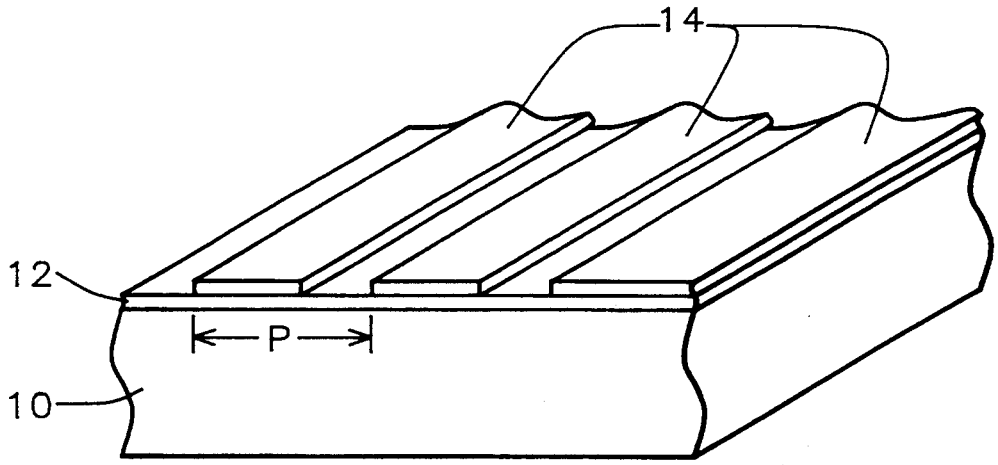
FIGS. 1 to 4, 4A, 5A, 5B and 6 demonstrate a first embodiment method for fabricating the high resolution flat panel display having single field emission microtip redundancy with resistive base, and the resulting structure.

Referring now to FIGS. 1 through 6 the first embodiment will be described. A dielectric substrate 10 is chosen. The substrate is typically glass, silicon wafer, or the like. If glass, it is preferred to use Corning 7740 or 7059. Depending upon the type of substrate used it may be preferred to use a dielectric layer 12 over the surface of the substrate 10. Such a layer may be for example, aluminum oxide ($Al_2O_3$) or silicon dioxide ($SiO_2$) which would be deposited or thermally grown (in the case of $SiO_2$) by conventional integrated circuit processes and having a thickness of between about 5,000 to 20,000 Angstroms. Usually this layer is used to obtain good adhesion for subsequent layers. When a silicon substrate is used for substrate 10, a thermally grown oxide is preferred for dielectric layer 12. If a glass substrate 10 is used, then a deposited $SiO_2$ or $Al_2O_3$ is preferred. A conductive layer 14 composed of molybdenum, aluminum, tungsten, etc, or doped polysilicon is deposited by sputtering, electron beam evaporation or chemical vapor deposition (CVD) and has a thickness of between about 500 to 10,000 Angstroms. The layer 14 is patterned by conventional lithography and etching techniques into parallel, spaced conductors 14 acting as cathode columns for the display being formed upon the substrate 10 and dielectric 12. Alternatively, the insulating layer 12 may not be used. We have shown the presence of this layer 12 in FIG. 1, but have left it out in subsequent Figures. Each spaced conductor 14 has a width of between about 0.1 to 0.3 mm., a distance between conductors of between about 0.005 to 0.1 mm, and a spacing P of between about 0.105 to 0.4 mm. This results in the FIG. structure.

Figure 2:
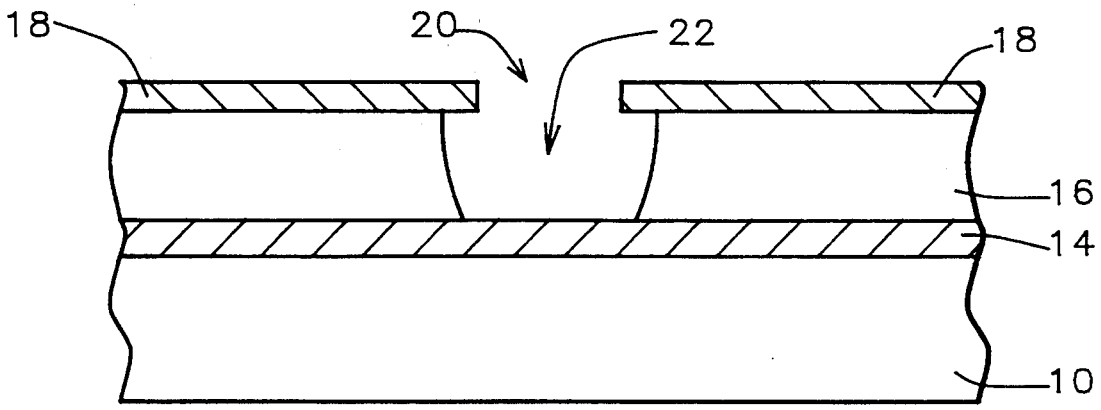

Referring now to FIG. 2, the process continues by forming an insulator layer 16 which is preferably silicon oxide ($SiO_2$), but could alternatively be aluminum oxide ($Al_2O_3$). This layer 16 is deposited by sputtering, e-beam evaporation, or CVD, and has a thickness of between about 5,000 to 20,000 Angstroms. Layer 18 is deposited using amorphous silicon, polycrystalline silicon or other conductive materials, typically by Low Pressure Chemical Vapor Deposition (LPCVD), to a thickness of between about 500 and 5000 Angstroms. Layer 18 forms the gate lines for the display. Opening 20 is formed by etching layer 18 by conventional lithography and etching, and has a diameter of between about 0.5 and 1.0 microns. Insulator layer 16 is now etched by reactive ion etching followed by a short isotropic chemical etch to form the enlarged openings 22 which undercut the gate lines 18. The etching chemical is chosen to stop at the cathode columns 14 and is buffered HF (hydrofluoric acid). This results in the structure shown in FIG. 2.

Figure 3:
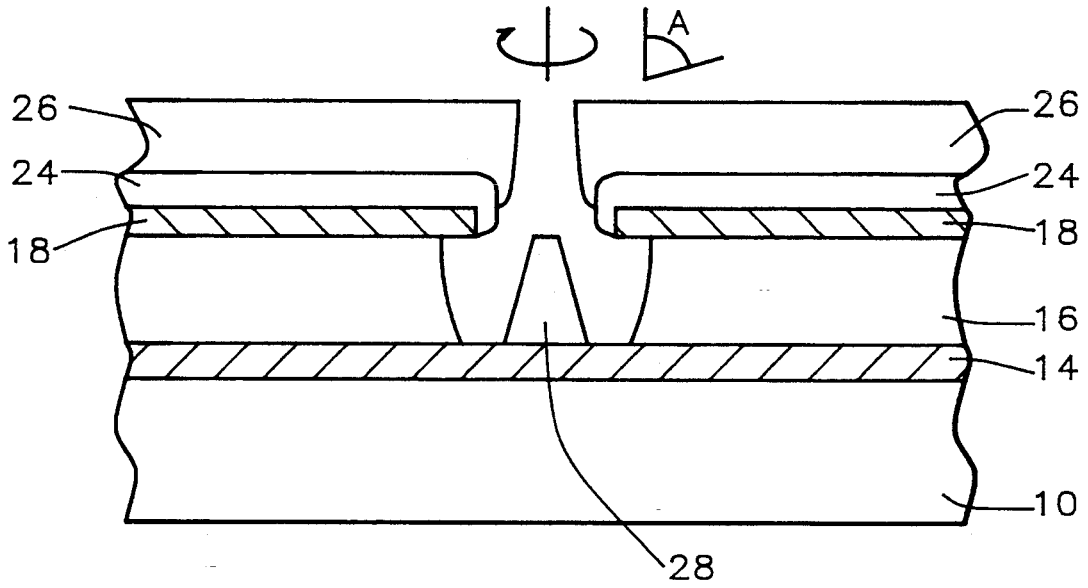

Referring now to FIG. 3, there is shown the critical method used to form the resistive base for the field emission microtip redundancy pattern. A first sacrificial layer 24 of nickel or metal oxide is deposited by e-beam evaporation using graze angle deposition (to prevent filling of opening 20) by tilting the wafer to an angle A of 75°. The thickness of this layer is between about 500 and 2000 Angstroms. Layer 26 and resistive base 28 are formed by depositing zinc oxide (ZnO), amorphous silicon or doped polysilicon vertically by electron-beam deposition. The thickness of layer 26 is between about 500 and 2000 Angstroms. Resistive base 28 has a resistance of between about 10 and 100 Mohms, and a height of between about 8000 and 10,000 Angstroms, or nearly as high as the gate-to-cathode spacing, and is connected to cathode conductor 14.

Figure 4:
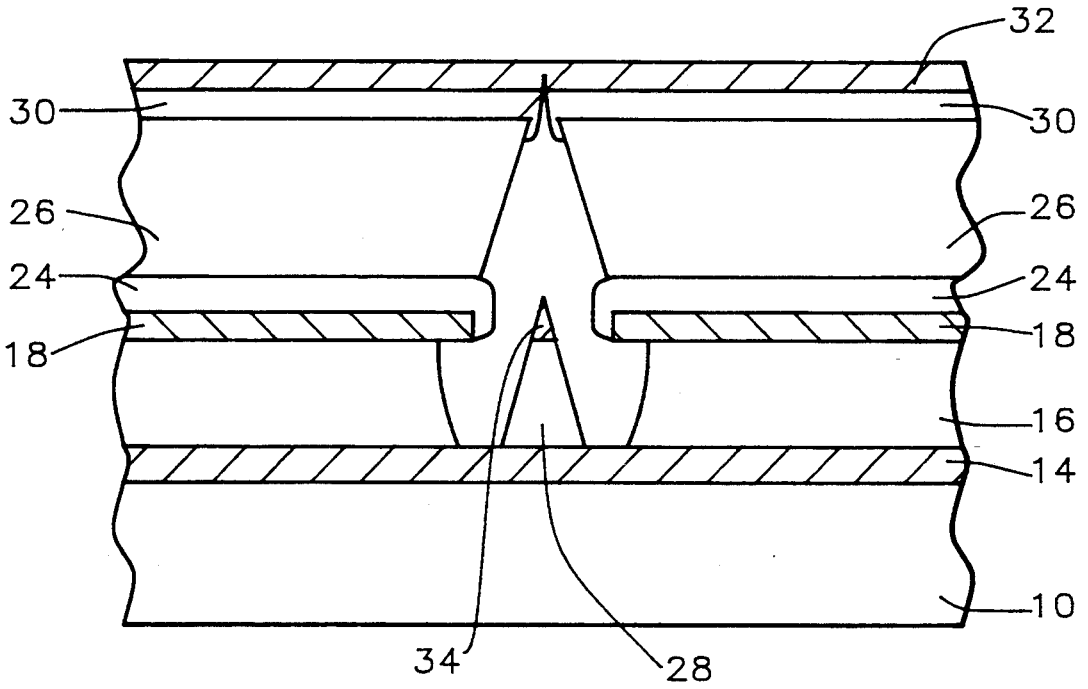

Referring now to FIG. 4, a hole-opening reduction layer 30, of the same material as layer 26, is deposited in the same way as the first sacrificial layer 24, i.e., by graze angle deposition. The thickness of this layer is between about 500 and 1000 Angstroms. Enclosure layer 32 is formed using molybdenum (Mo), tungsten (W) or other metals which emit electrons and is deposited vertically to a thickness of between about 10 and 100 Angstroms by e-beam deposition. This forms microemitter tip 34 on resistive base 28. Each tip has a total height (base plus tip) of between about 0.8 and 1.2 microns and protrudes through the gate layer opening. The very small tip size, as compared to the large resistive base pedestal, improves reliability of any device using this emitter forming method, for if a metal tip breaks down there is not sufficient material to cause shorting to the gate.

Figure 4A:
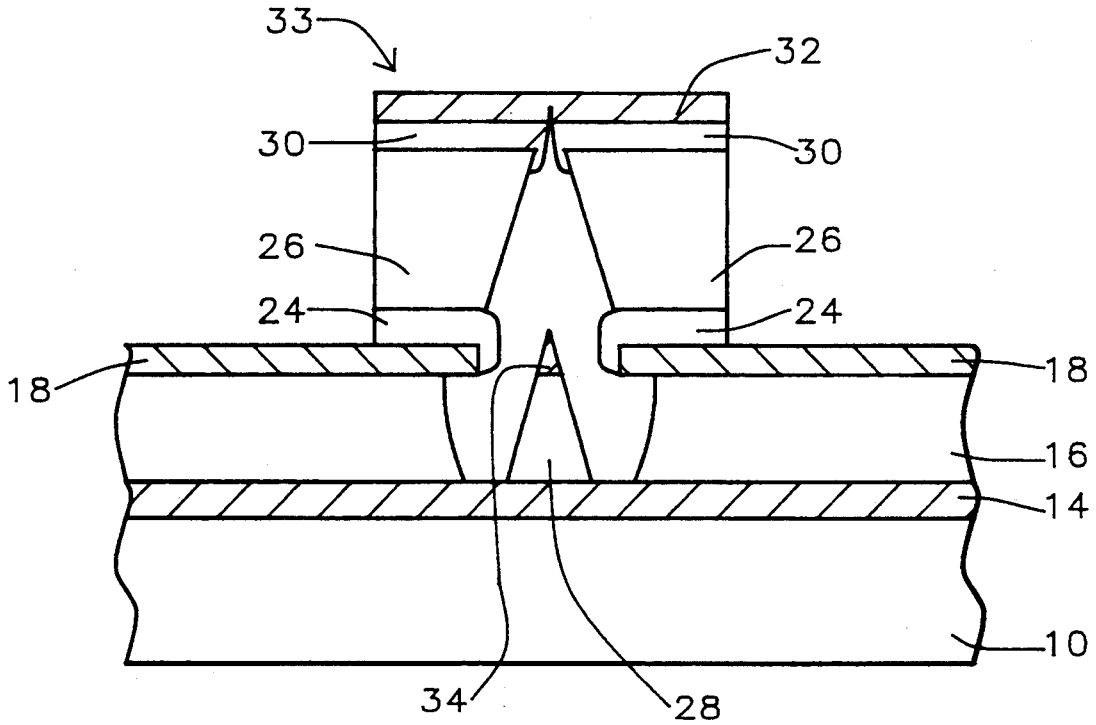

A tip protection cap 33 is now formed on layer 30, as shown in FIG. 4A. The cap 33 is patterned by conventional means over each microtip. Layers 26, 30 and 32 are etched in the regions not masked by the protection cap by an anisotropic etch, using layer 24 as an etch stop. Layer 24 is then also removed by an anisotropic etch to result in the FIG. 4A structure. A lift-off process, for example a wet etch using buffered HF (hydrofluoric acid) removes the remainder of sacrificial layer 24 and lifts off the entire cap structure to expose the emitter tips.

Figure 5A:
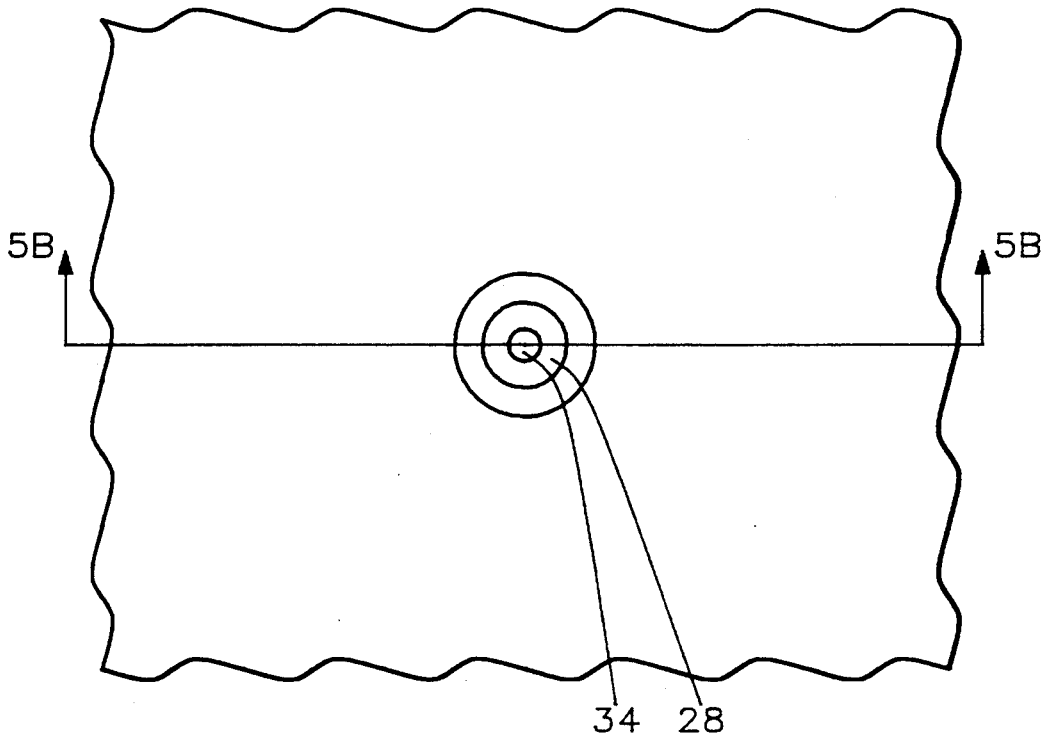
Figure 5B:
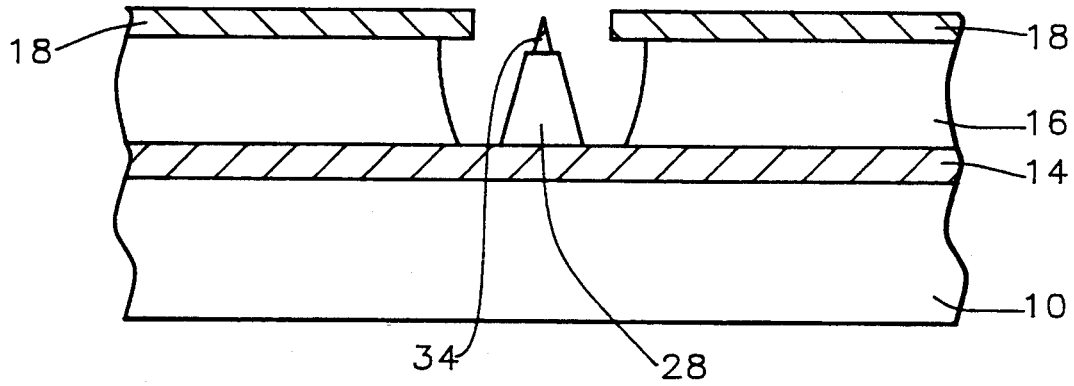
Figure 6:
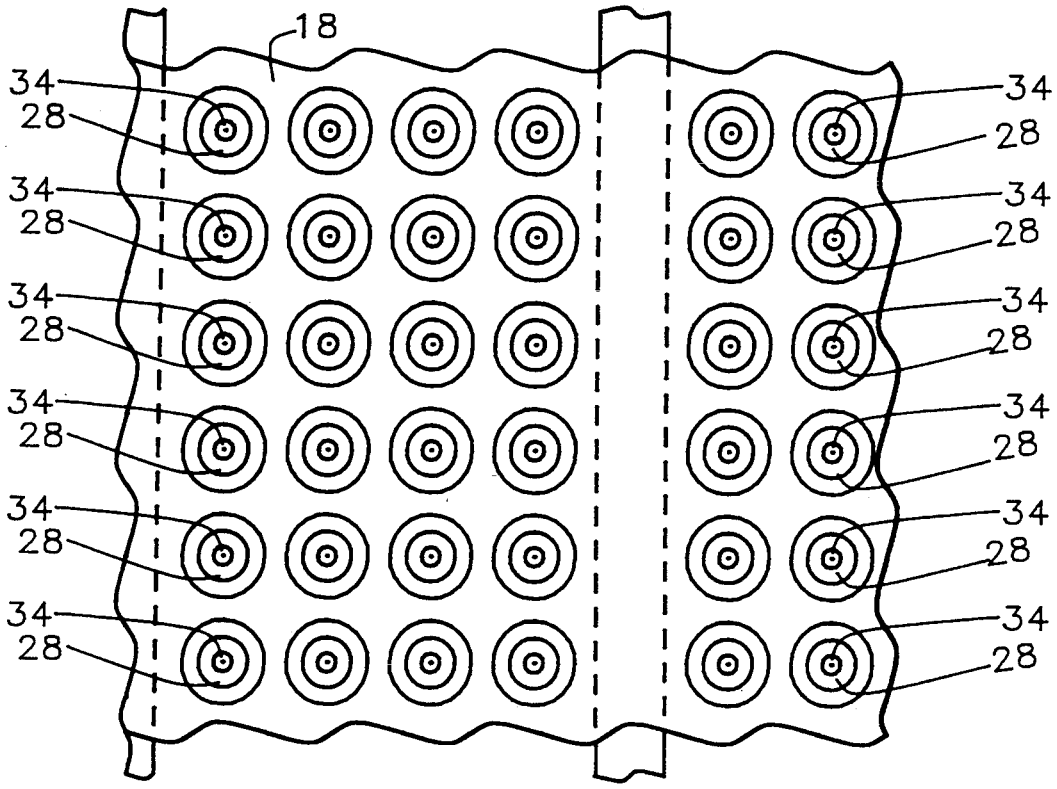

The result of these process steps is shown in FIG. 5A from a top view for each single field emission microtip redundancy structure. There are between about 10 and 1000 of these microtip structures at each pixel. FIG. 5B shows the cross-sectional view taken along line 5B—5B of FIG. 5A. FIG. 6 shows the top view of a pattern of field emission microtip structures at a pixel. It should be understood that the FIG. 6 is only a schematic illustration of a pixel and an adjacent half pixel, the actual number of the microtip structures can be hundreds of times more than are shown in the drawing.

Using the resistive base with the single tip redundancy solves the problems of cathode destruction or dead shorts caused by inability to sustain the cathode-gate voltage. The resistive base provides a load line for uniform emission property and, by using silicon in the resistive base, any short between the gate and cathode will melt the resistive base first. This leads to a higher resistive path between the gate and cathode, thus sustaining the gate-cathode voltage and preventing dead shorts. The metal part on the top of the tip is a very thin layer, between about 10 and 100 Angstroms thick, thus providing very little to the conductive path.

The single tip redundancy with resistive base can reduce the number of tips in each pixel, and there is no need for subpixels. If one tip fails in the prior art devices, the whole subpixel fails. This means that the number of subpixels should be about 10 or more, so when a subpixel fails only 10% of the tips in the pixel no longer work. Since the single tip redundancy method with resistive base does not require subpixels, as few as 10 tips total can be used per pixel. Thus, a much smaller area is required for each pixel and a much higher resolution display can be achieved.

Figure 7:
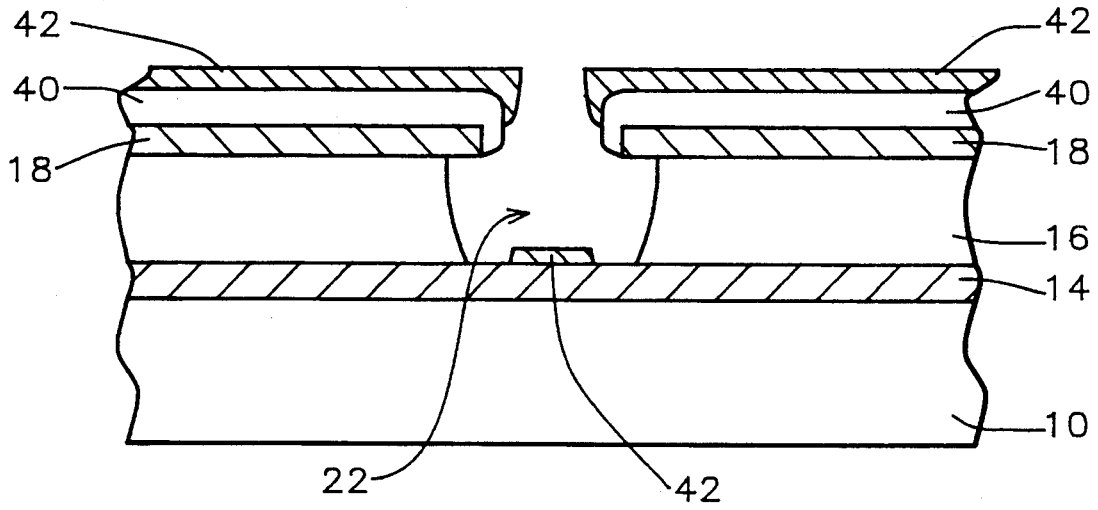
FIGS. 7 to 9 demonstrate a second embodiment method for fabricating the high resolution flat panel display having single field emission microtip redundancy with resistive base, and the resulting structure.
Figure 8:
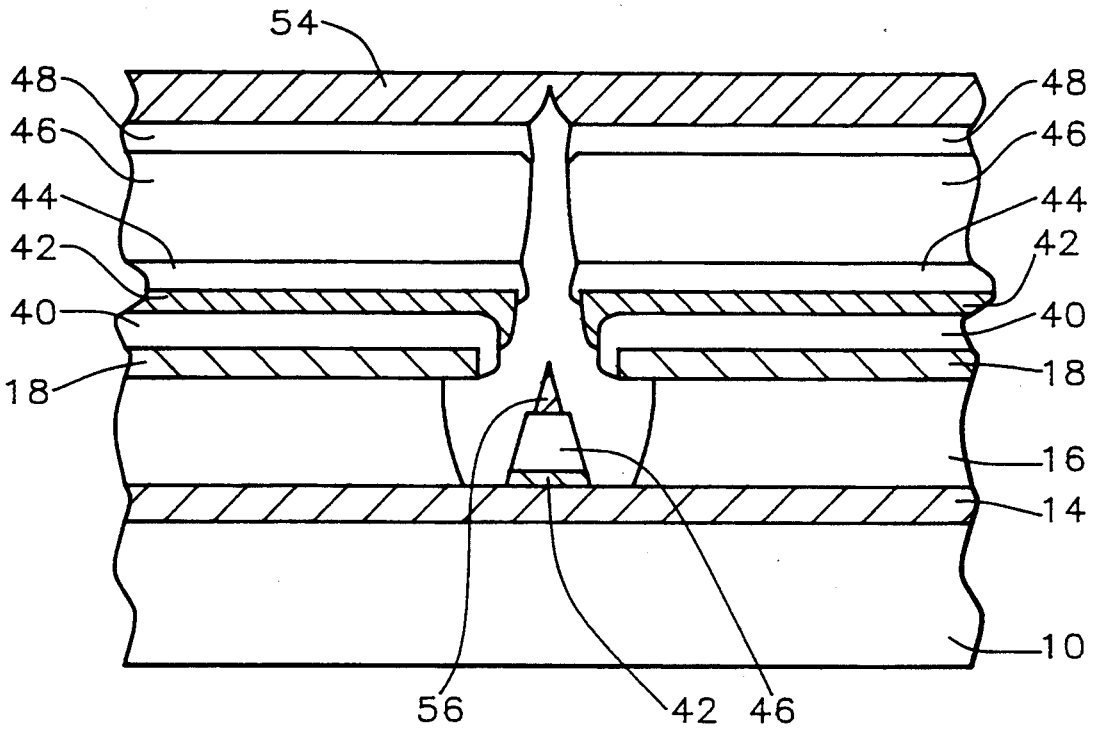
Figure 9:
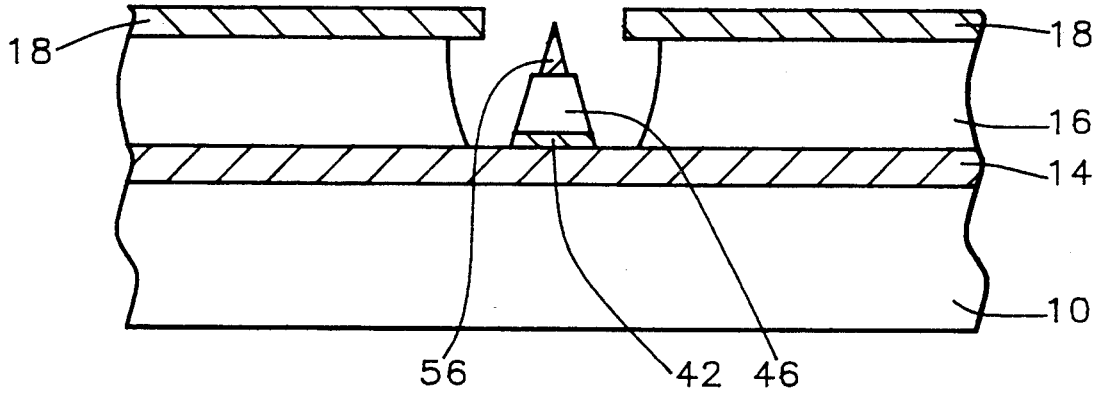

A second embodiment can be understood with reference to FIGS. 7 to 9. Starting with the structure shown in FIG. 2, for which the process steps are the same as in the first embodiment, and referring now to FIG. 7, a first sacrificial and opening reduction layer 40 of nickel or silicon oxide is deposited by e-beam evaporation using graze angle deposition (to prevent filling of the opening) by tilting the wafer to an angle A of 75°. The thickness of this layer is between about 500 and 1000 Angstroms. First metal layer 42 is formed by depositing Mo, W or similar metals vertically by e-beam deposition. Layer 42 has a thickness of between about 100 and 500 Angstroms and is connected to cathode conductor 14 within opening 22.

Referring now to FIG. 8, a second hole-reduction layer 44 is deposited using the same material and deposition technique as for layer 40. A first resistive layer 46 is vertically deposited to a thickness of between about 8000 and 10,000 Angstroms, using amorphous silicon, doped polysilicon zinc oxide or any material that may be used to form a resistive layer. A second hole-reduction layer 48 of nickel or silicon oxide is deposited by e-beam evaporation using graze angle deposition. Enclosure layer 54 is formed using molybdenum (Mo), tungsten (W) or other metals which emit electrons and is deposited vertically to a thickness of between about 100 and 200 Angstroms by e-beam deposition. This forms microemitter tip 56 on resistive base 46. Each tip has a height of between about 100 and 1000 Angstroms. The resistor 46 has a height of between about 0.8 and 1.0 microns, and conductor 42 has a height of between about 200 and 1000 Angstroms.

The number of layers of the second embodiment of the invention, under the tip 56, may be varied, and is not limited to the two layers described above. The layers above the gate line 18 are now removed using the same methods as in the first embodiment, to result in the structure shown in FIG. 9.

Figure 10:
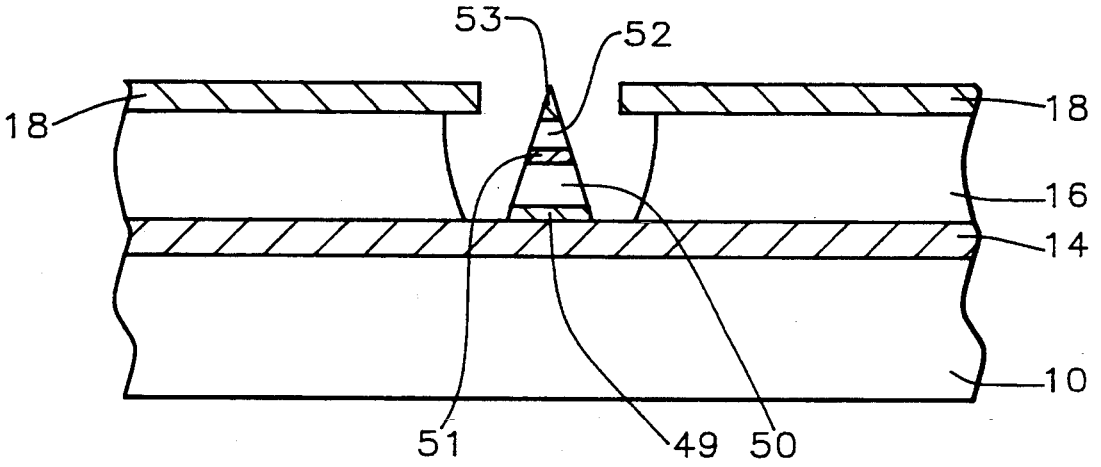
FIGS. 10 and 11 demonstrate the use of low work-function material in the resistive base using the method of the second embodiment.

The method of the second embodiment may be used to create a low work-function material reservoir, in which two additional layers and different materials are used to form the emitter. The structure formed is shown in FIG. 10. The first thin conductive layer 49 is nickel or another conductor, deposited to a thickness of between about 800 and 1200 Angstroms. Layer 50 is the resistive base and is formed of the same materials as layer 46 in FIG. 9 of the second embodiment, to a thickness of between about 4000 and 6000 Angstroms. A second conductive layer 51 is formed on the resistive base of, for example, Mo, and has a thickness of between about 800 and 1200 Angstroms. Layer 52 is the low work-function material, formed of a composition of barium oxide (BaO), calcium oxide (CaO) and aluminum oxide ($Al_2O_3$), in the ratio 5:3:2 of BaO:CaO:$Al_2O_3$, or alternately a ratio of 4:1:1. This composition is deposited by low temperature e-beam evaporation, using three targets to adjust the ratio, and has a thickness of between about 2400 and 3600 Angstroms. Finally, layer 53 is the metal tip formed of, for instance, tungsten (W), by e-gun evaporation, to a height of between about 1600 and 2400 Angstroms, on top of the BaO:CaO:$Al_2O_3$ pedestal. Stresses due to the differing thermal coefficients of expansion of the two layers 52 and 53, for instance during and after deposition, will cause cracks to form in the tip 53, making it porous. On operation of the emitter, the resistive base heats up, and subsequently the low work-function material is activated and penetrates the now porous tungsten tip, thus improving electron emission from the tip.

Figure 11:
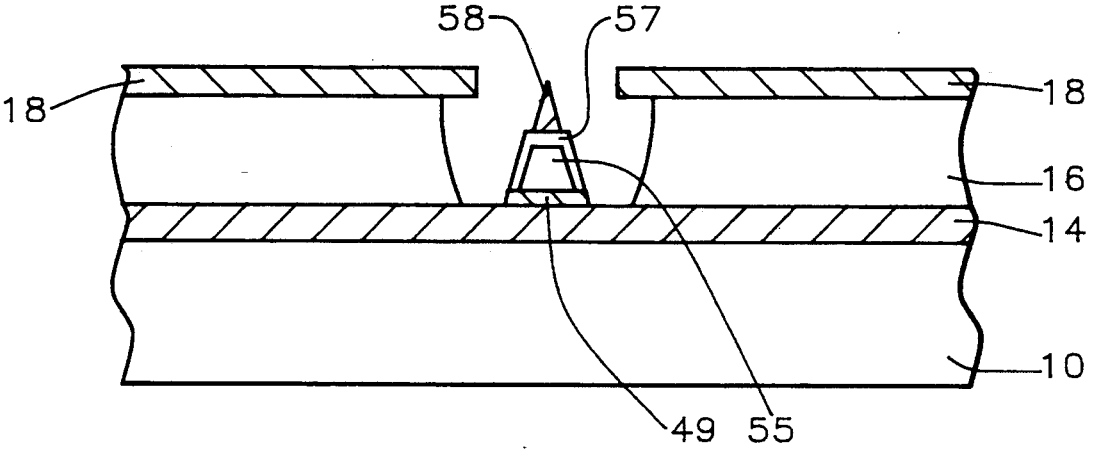

An alternative low-work function material reservoir structure is shown in FIG. 11. After formation of the conductive layer 49 on base 14, low work-function material layer 55 is formed. This can be accomplished by, for instance, forming a thicker opening-reduction layer (by graze angle deposition) than is shown in the second embodiment, leaving space on either side of layer 55. The low work-function material may be BaO:CaO:$Al_2O_3$, as discussed above. Subsequently, the two layers above gate 18 of low-work function material and the opening-reduction layer may be stripped to increase the size of the opening. Then layer 57 is deposited to form an envelope around the low-work function material, as shown in FIG. 11. Processing then continues as in the second embodiment to form the tip 58 of, for example, tungsten, and removing the tip-protection cap. Tip emission would then be improved after activation of the low work-function material and penetration of the porous metal tip.

Figure 12:
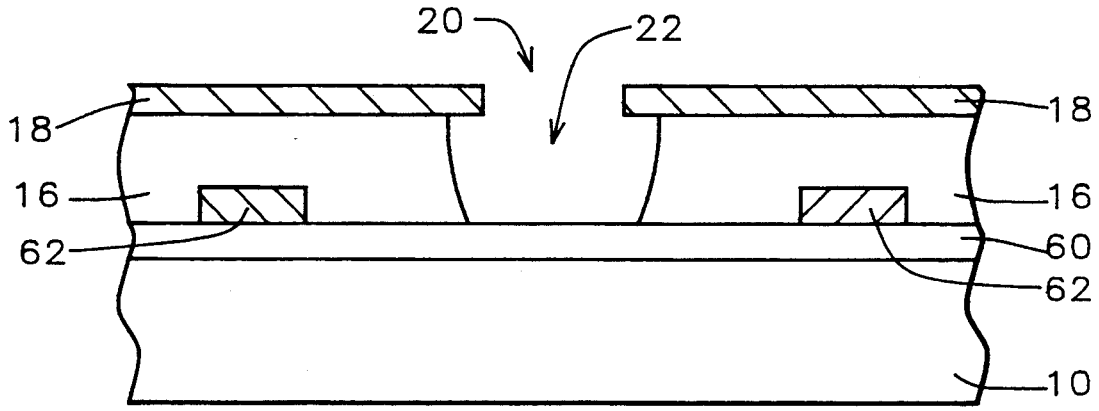
FIG. 12 and 13 shows the resulting structure of a third embodiment method for fabricating the high resolution flat panel display having single field emission microtip redundancy with resistive base.
Figure 13:
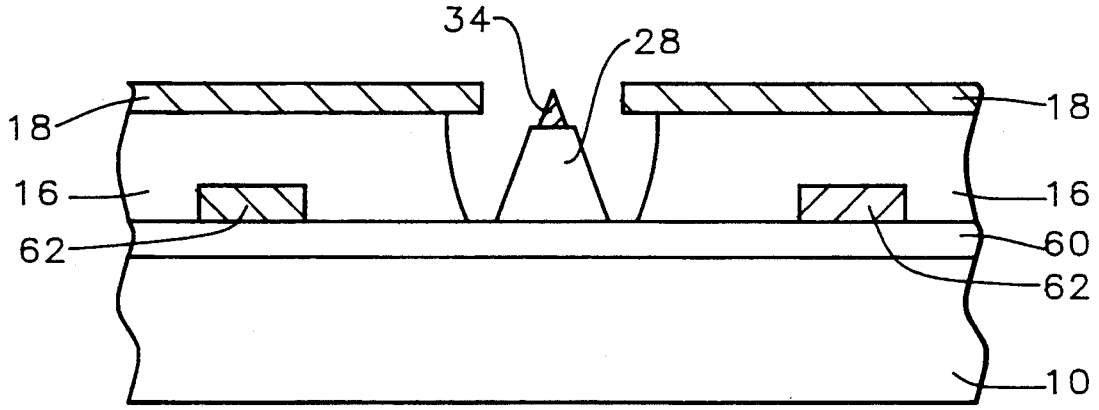

The third embodiment of the invention is now described with reference to FIGS. 12 and 13. Referring to FIG. 12, a dielectric substrate 10 is chosen as in the first two embodiments. A resistive layer 60 is formed of amorphous silicon, polysilicon, ITO, or the like and is deposited by sputtering, evaporation or CVD, to a thickness of between about 500 and 20,000 Angstroms. Meshed cathode conductors 62 are now formed by depositing a conductive layer of molybdenum, aluminum, tungsten, etc, or doped polysilicon, by sputtering, electron beam evaporation or chemical vapor deposition (CVD) and has a thickness of between about 500 and 20,000 Angstroms. This layer is patterned by conventional lithography and etching techniques into meshed, parallel, spaced conductors 62. Each conductor 62 has a width of between about 1.0 and 5.0 microns. Processing continues using the same methods as in the first embodiment to form layers 16 and 18, and in forming resistive base 28 and microemitter tip 34, to result in the structure as shown in FIG. 13. Each microemitter with resistive base is connected to resistive layer 60, and has a pair of cathode conductors adjacent to it.

While the invention has been particularly shown and described with reference to the preferred embodiments thereof, it will be understood by those skilled in the art that various changes in form and details may be made without departing from the spirit and scope of the invention.

What is claimed is:

1. A high resolution matrix addressed flat panel display having single field emission microtip redundancy with resistive base comprising:

a dielectric base substrate;

parallel, spaced conductors acting as cathode columns for said display being formed over said substrate;

a layer of insulation over said cathode columns;

parallel, spaced conductors acting as gate lines for said display being formed over said layer of insulation at a right angle to said cathode columns;

the intersections of said cathode columns and gate lines are pixels of said display;

a plurality of openings at said pixels extending through said insulating layer and said gate lines;

at each of said openings is a resistive base connected to said cathode conductor column; and a small metallic field emission microtip on each of said resistive bases, extending up from said resistive base and into said opening in said gate line, the height of said microtip being many times smaller than the height of said resistive base.

2. The flat panel display of claim 1 wherein said resistive base has a height of between about 8000 and 10,000 Angstroms, and a resistance of between about 10 and 100 Mohms.

3. The flat panel display of claim 2 wherein said resistive base is formed of zinc oxide.

4. The flat panel display of claim 3 wherein the height of said field emission microtip is between about 10 and 100 Angstroms.

5. The flat panel display of claim 1 wherein said resistive base is composed of alternating layers of a conductive material and a resistive material.

6. The flat panel display of claim 5 wherein said alternating layers comprise a first metal layer of a thickness of between about 100 and 500 Angstroms connected to said cathode conductor column, and a resistive layer with a thickness of between about 8000 and 10,000 Angstroms over said conductive layer.

7. The flat panel display of claim 5 wherein said resistive base comprises a first metal layer connected to said cathode conductor column, a resistive layer on said first metal layer, a second metal layer on said resistive layer, and a low-work function material layer on said second metal layer.

8. The flat panel display of claim 7 wherein said low work-function material layer is formed of a composition of barium oxide, calcium oxide and aluminum oxide.

9. The flat panel display of claim 8 wherein said composition has a ratio of 5:3:2.

10. The flat panel display of claim 9 wherein said composition has a ratio of 4:1:1.

11. The flat panel display of claim 10 wherein said microtip is formed of tungsten.

12. The flat panel display of claim 1 further comprising a resistive layer between said dielectric substrate and said cathode conductor columns, wherein said cathode conductor columns are adjacent to each of said field emission microtips with resistive base, said resistive bases are connected to said cathode conductor columns through said resistive layer, and said resistive base extends up from said resistive layer.

13. A method of fabricating a high resolution matrix addressed flat panel display having cathode columns and gate lines and field emission microtip redundancy with resistive base, comprising the steps of:

forming parallel, spaced conductors acting as said cathode columns for said display on a dielectric base substrate;

forming a layer of insulation over said cathode columns;

forming second parallel, spaced conductors acting as gate lines for said display over said layer of insulation, at a right angle to said cathode columns;

forming a plurality of openings at the intersections of said first and second parallel, spaced conductors, said openings extending through said insulating layer and said gate lines;

forming in each of said openings a resistive base connected to said cathode conductor column; and forming over said resistive base a small metallic field emission microtip, extending up from said resistive base and into said opening in said gate line, the height of said microtip being many times smaller than the height of said resistive base.

14. The method of claim 13 wherein said resistive base is formed to a height of between about 8000 and 10,000 Angstroms, and has a resistance of between about 10 and 100 Mohms.

15. The method of claim 14 wherein said resistive base is formed of zinc oxide.

16. The method of claim 15 wherein the height of said field emission microtip is between about 10 and 100 Angstroms.

17. The method of claim 16 wherein said resistive base is formed by depositing alternating layers of a conductive material and a resistive material.

18. The method of claim 17 wherein said alternating layers comprise a first metal layer of a thickness of between about 100 and 500 Angstroms connected to said cathode conductor column, and a resistive layer with a thickness of between about 8000 and 10,000 Angstroms formed over said conductive layer.

19. The method of claim 18 wherein said resistive base is formed comprising the steps of:

forming a first sacrificial layer over said gate lines by graze angle deposition, to a thickness of between about 500 and 2000 Angstroms; and depositing vertically a layer of resistive material such that said resistive base is formed in said opening, over said cathode columns, and a resistive layer also is formed over said first sacrificial layer.

20. The method of claim 19 wherein said small field emission microtip is formed comprising the steps of:

forming a second sacrificial layer over said resistive layer by graze angle deposition, to a thickness of between about 500 and 1000 Angstroms; and depositing vertically a layer of conductive material such that said small field emission microtip is formed on said resistive base, and said conductive material forms a thin enclosure layer over said second sacrificial layer, which fully encloses said opening.

21. The method of claim 20 further comprising the steps of:

forming a tip protection layer on said enclosure layer;

patterning said tip protection layer to form a cap of width greater than opening in said gate line;

removing portions of said enclosure layer, said second sacrificial layer, said resistive layer and said first sacrificial layer in the region not vertically masked by said cap, by anistropic etching; and removing said cap and said portions by etching in buffered hydrofluoric acid, which dissolves the remaining portion of said first sacrificial layer, to expose said small field emission microtip.

22. The method of claim 21 further comprising the steps of:

vertically depositing a metallic material to form a first metal layer over said first sacrificial layer, and a metal base in said opening over said cathode columns, such that said resistive base is formed upon said metal base; and forming a third sacrificial layer by graze angle deposition over said first metal layer, such that said resistive layer is formed on said third sacrificial layer.

23. The method of claim 13 further comprising forming a resistive layer over said dielectric substrate and wherein said cathode conductor columns are formed upon said resistive layer and are patterned to form a meshed conductor such that said cathode conductor columns are adjacent to each of said field emission microtips with resistive base, and said resistive base is formed on said resistive layer.

24. The method of claim 23 wherein said resistive base is deposited to a thickness of between about 500 and 20,000 Angstroms.

25. A method of fabricating a field emission device with a small metallic emitting tip on a large resistive base, comprising the steps of:

forming parallel, spaced conductors on a dielectric base substrate;

forming a layer of insulation over said parallel, space conductors;

forming second parallel, spaced conductors over said layer of insulation, at a right angle to said first parallel, spaced conductors;

forming a plurality of openings at the intersections of said first and second parallel, spaced conductors, said openings extending through said insulating layer and said second parallel, spaced conductors;

forming in each of said openings said large resistive base connected to said cathode conductor column; and forming said small metallic field emission tip over said large resistive base, said tip extending up from said resistive base and into said opening in said gate line the height of said tip being many times smaller than the height of said resistive base.

26. The method of claim 25 wherein said resistive base is formed to a height of between about 8000 and 10,000 Angstroms, and has a resistance of between about 10 and 100 Mohms.

27. The method of claim 26 wherein said small emitting tip is formed to a height of between about 10 and 100 Angstroms.

28. The method of claim 25 wherein said resistive base is formed of zinc oxide.

29. A high resolution matrix addressed flat panel display having single field emission microtip redundancy with resistive base comprising:

a dielectric base substrate;

parallel, spaced conductors acting as cathode columns for said display being formed over said substrate;

a layer of insulation over said cathode columns;

parallel, spaced conductors acting as gate lines for said display being formed over said layer of insulation at a right angle to said cathode columns;

the intersections of said cathode columns and gate lines are pixels of said display;

a plurality of openings at said pixels extending through said insulating layer and said gate lines;

at each of said openings is a resistive base connected to said cathode conductor column; and a small metallic field emission microtip on each of said resistive bases, extending up from said resistive base and into said opening in said gate line, the height of said microtip being many times smaller than the height of said resistive base and is between about 10 and 100 Angstroms.

30. The flat panel display of claim 29 wherein said resistive base has a height of between about 8000 and 10,000 Angstroms, and a resistance of between about 10 and 100 Mohms.

31. The flat panel display of claim 29 wherein said resistive base is composed of alternating layers of a conductive material and a resistive material.

32. The flat panel display of claim 31 wherein said alternating layers comprise a first metal layer of a thickness of between about 100 and 500 Angstroms connected to said cathode conductor column, and a resistive layer with a thickness of between about 8000 and 10,000 Angstroms over said conductive layer.

33. The flat panel display of claim 31 wherein said resistive base comprises a first metal layer connected to said cathode conductor column, a resistive layer on said first metal layer, a second metal layer on said resistive layer, and a low-work function material layer on said second metal layer.

34. The flat panel display of claim 33 wherein said low work-function material layer is formed of a composition of barium oxide, calcium oxide and aluminum oxide wherein said composition has a ratio of 5:3:2.

35. The flat panel display of claim 29 further comprising a resistive layer between said dielectric substrate and said cathode conductor columns, wherein said cathode conductor columns are adjacent to each of said field emission microtips with resistive base, said resistive bases are connected to said cathode conductor columns through said resistive layer, and said resistive base extends up from said resistive layer.

* * * * *